US006600108B1

(12) United States Patent
Mydur et al.

(10) Patent No.: US 6,600,108 B1
(45) Date of Patent: Jul. 29, 2003

(54) ELECTRIC CABLE

(75) Inventors: Ravicharan Mydur, Houston, TX (US); Joseph P. Varkey, Missouri City, TX (US); Sumit Sarkar, Houston, TX (US); Willem A. Wijnberg, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/057,553

(22) Filed: Jan. 25, 2002

(51) Int. Cl.[7] ..... H01B 9/02; H01B 11/22
(52) U.S. Cl. ..... 174/120 R; 385/101
(58) Field of Search ..... 174/106 R, 102 R, 174/105 R, 113 R, 120 R; 385/101, 100, 106, 109, 107, 111

(56) References Cited

U.S. PATENT DOCUMENTS

| | | | | |
|---|---|---|---|---|
| 4,440,974 A | | 4/1984 | Naudet | |
| 5,086,196 A | * | 2/1992 | Brookbank et al. | 174/106 R |
| 5,495,547 A | | 2/1996 | Rafie et al. | |
| 6,060,662 A | * | 5/2000 | Rafie et al. | 174/106 R |
| 6,195,487 B1 | * | 2/2001 | Anderson et al. | 385/101 |
| 6,201,191 B1 | | 3/2001 | Yorita et al. | |
| 6,236,789 B1 | * | 5/2001 | Fitz | 385/101 |
| 6,403,889 B1 | * | 6/2002 | Mehan et al. | 174/120 R |

FOREIGN PATENT DOCUMENTS

JP 4-92110 * 3/1992

OTHER PUBLICATIONS

S.M. Lebedev, O.S. Gefle, Yu.P.Pokholkov and V.I. Chichikin, "The Breakdown Strength of Two–Layer Dielectrics", Tomsk Polytechnic University, Tomsk, Russia #4.304.P2, High Voltage Engineering Symposium, Aug. 22–27, 1999.

M.M.A. Salama, R.Hackam, Fellow and A.Y. Chikhani, Sr., "Instructional Design of Multi–Layer Insulation of Power Cables", Transaction on Power Systems, vol. 7, No. 1, Feb. 1992, pp. 377–382.

* cited by examiner

*Primary Examiner*—Chau N. Nguyen
(74) *Attorney, Agent, or Firm*—Wayne I. Kanak; Brigitte L. Jeffery; John J. Ryberg

(57) ABSTRACT

A cable includes an electrical conductor, a first insulating jacket disposed adjacent the electrical conductor and having a first relative permittivity, and a second insulating jacket disposed adjacent the first insulating jacket and having a second relative permittivity that is less than the first relative permittivity. A method includes providing an electrical conductor, extruding a first insulating jacket having a first relative permittivity over the electrical conductor, and extruding a second insulating jacket having a second relative permittivity over the electrical conductor, wherein the second relative permittivity is less than the first relative permittivity.

24 Claims, 5 Drawing Sheets

ELECTRIC CABLE

BACKGROUND OF THE INVENTION

1. Field of the Invention

This invention relates to an electric field suppressing cable and a method of using same. In one aspect, the invention relates to an electric field suppressing cable used with devices to analyze geologic formations adjacent a well before completion and a method of using same.

2. Description of Related Art

Generally, geologic formations within the earth that contain oil and/or petroleum gas have properties that may be linked with the ability of the formations to contain such products. For example, formations that contain oil or petroleum gas have higher electrical resistivities than those that contain water. Formations generally comprising sandstone or limestone may contain oil or petroleum gas. Formations generally comprising shale, which may also encapsulate oil-bearing formations, may have porosities much greater than that of sandstone or limestone, but, because the grain size of shale is very small, it may be very difficult to remove the oil or gas trapped therein.

Accordingly, it may be desirable to measure various characteristics of the geologic formations adjacent to a well before completion to help in determining the location of an oil- and/or petroleum gas-bearing formation as well as the amount of oil and/or petroleum gas trapped within the formation. Logging tools, which are generally long, pipe-shaped devices, may be lowered into the well to measure such characteristics at different depths along the well.

These logging tools may include gamma-ray emitters/receivers, caliper devices, resistivity-measuring devices, neutron emitters/receivers, and the like, which are used to sense characteristics of the formations adjacent the well. A wireline cable connects the logging tool with one or more electrical power sources and data analysis equipment at the earth's surface, as well as providing structural support to the logging tools as they are lowered and raised through the well. Generally, the wireline cable is spooled out of a truck, over a pulley, and down into the well.

As may be appreciated, the diameter of the wireline cable is generally constrained by the handling properties of the cable. For example, a wireline cable having a large diameter may be very difficult to spool and unspool. As a result, many wireline cables have diameters that are generally less than about 13 mm, and thus have a fixed cross-sectional area through which to run conductors for transmitting power to the logging tools and for transmitting data signals from the logging tools. Further, such cables may have lengths of up to about 10,000 m so that the logging tools may be lowered over the entire depth of the well.

Long cable lengths, in combination with small conductors (e.g., 14 AWG to 22 AWG) within the cables, may lead to significant electrical losses, resulting in a reduction in the power received by the logging tools and distortion or attenuation of the data signals transmitted from the logging tools. Further, as logging tools have evolved, the power required to operate the tools has increased. However, the power-transmitting capacity of such cables is limited by the conductor size and the voltage rating of the conductor. Thus, a need exists for cables that are capable of conducting larger amounts of power while reducing undesirable electrical effects induced in both the electrical power and data signals transmitted over the conductors of the cable.

Further, conventional wireline cables may use layers of metallic armor wires that encase the exterior of the wireline cable as a return for electrical power transmitted to the logging tools so that conductors internal to the cable may be used for power and data transmission. Such configurations may present a hazard to personnel and equipment that inadvertently come into contact with the armor wires during operation of the logging tools. Thus, a need exists for a wireline cable that avoids using the metallic armor as an electrical return.

Such problems are also faced in other applications in which the size of electrical cables is constrained and increased electrical power is desired, such as in marine and seismic applications. The present invention is directed to overcoming, or at least reducing, the effects of one or more of the problems detailed above.

BRIEF SUMMARY OF THE INVENTION

In one aspect of the present invention, a cable is provided. The cable includes an electrical conductor, a first insulating jacket disposed adjacent the electrical conductor and having a first relative permittivity, and a second insulating jacket disposed adjacent the first insulating jacket and having a second relative permittivity that is less than the first relative permittivity.

In another aspect of the present invention, a method is provided including providing an electrical conductor coupled to a device and having a multi-layered insulating jacket capable of suppressing an electrical field induced by a voltage applied to the electrical conductor and conducting an electrical current through the conductor to or from the device.

In yet another aspect of the present invention, a method is provided for manufacturing a cable. The method includes providing an electrical conductor, extruding a first insulating jacket having a first relative permittivity over the electrical conductor, and extruding a second insulating jacket having a second relative permittivity over the electrical conductor, wherein the second relative permittivity is less than the first relative permittivity.

BRIEF DESCRIPTION OF THE DRAWINGS

The invention may be understood by reference to the following description taken in conjunction with the accompanying drawings, in which the leftmost significant digit(s) in the reference numerals denote(s) the first figure in which the respective reference numerals appear, and in which.

Figure 1:
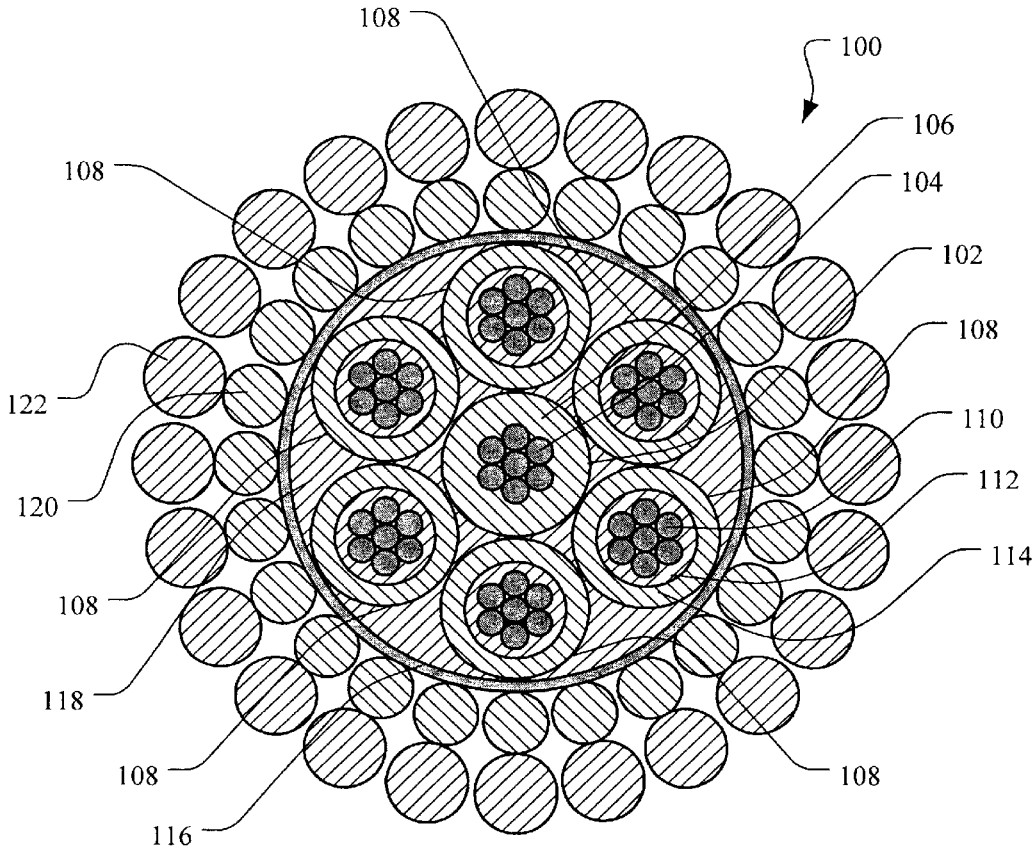
FIG. 1 is a stylized cross-sectional view of a first illustrative embodiment of a cable according to the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

An electrical voltage applied to an electrical conductor produces an electric field around the conductor. The strength of the electric field varies directly according to the voltage applied to the conductor. When the voltage exceeds a critical value (i.e., the inception voltage), a partial discharge of the electric field may occur. Partial discharge is a localized ionization of air or other gases near the conductor, which breaks down the air. In electrical cables, the air may be found in voids in material insulating the conductor and, if the air is located in a void very close to the surface of the conductor where the electric field is strongest, a partial discharge may occur. Such partial discharges are generally undesirable, as they progressively compromise the ability of the insulating material to electrically insulate the conductor.

If the electric field generated by electricity flowing through the conductor can be at least partially suppressed, the likelihood of partial discharge may be reduced. FIG. 1 depicts a first illustrative embodiment of a cable 100 according to the present invention. In the illustrated embodiment, the cable 100 includes a central insulated conductor 102 having a central conductor 104 and an insulating jacket 106. The cable 100 further includes a plurality of outer insulated conductors 108, each having an outer conductor 110 (only one indicated), a first insulating jacket 112 (only one indicated) and a second insulating jacket 114 (only one indicated).

The first insulating jacket 112 may be mechanically and/or chemically bonded to the second insulating jacket 114 so that the interface therebetween will be substantially free of voids. For example, the second insulating jacket 114 may be mechanically bonded to the first insulating jacket 112 as a result of molten or semi-molten material, forming the second insulating jacket 114, being adhered to the first insulating jacket 112. Further, the second insulating jacket 114 may be chemically bonded to the first insulating jacket 112 if the material used for the second insulating jacket 114 chemically interacts with the material of the first insulating jacket 112. The first insulating jacket 112 and the second insulating jacket 114 are capable of suppressing an electric field produced by a voltage applied to the outer conductor 110, as will be described below. The central insulated conductor 102 and the outer insulated conductors 108 are provided in a compact geometric arrangement to efficiently utilize the available diameter of the cable 100.

In the illustrated embodiment, the outer insulated conductors 108 are encircled by a jacket 116 made of a material that may be either electrically conductive or electrically non-conductive and that is capable of withstanding high temperatures. Such non-conductive materials may include the polyaryletherether ketone family of polymers (PEEK, PEKK), ethylene tetrafluoroethylene copolymer (ETFE), other fluoropolymers, polyolefins, or the like. Conductive materials that may be used in the jacket 116 may include PEEK, ETFE, other fluoropolymers, polyolefins, or the like mixed with a conductive material, such as carbon black.

The volume within the jacket 116 not taken by the central insulated conductor 102 and the outer insulated conductors 108 is filled, in the illustrated embodiment, by a filler 118, which may be made of either an electrically conductive or an electrically non-conductive material. Such non-conductive materials may include ethylene propylene diene monomer (EPDM), nitrile rubber, polyisobutylene, polyethylene grease, or the like. In one embodiment, the filler 118 may be made of a vulcanizable or cross-linkable polymer. Further, conductive materials that may be used as the filler 118 may include EPDM, nitrile rubber, polyisobutylene, polyethylene grease, or the like mixed with an electrically conductive material, such as carbon black. A first armor layer 120 and a second armor layer 122, generally made of a high tensile strength material such as galvanized improved plow steel, alloy steel, or the like, surround the jacket 116 to protect the jacket 116, the non-conductive filler 118, the outer insulated conductors 108, and the central insulated conductor 102 from damage.

Figure 2:
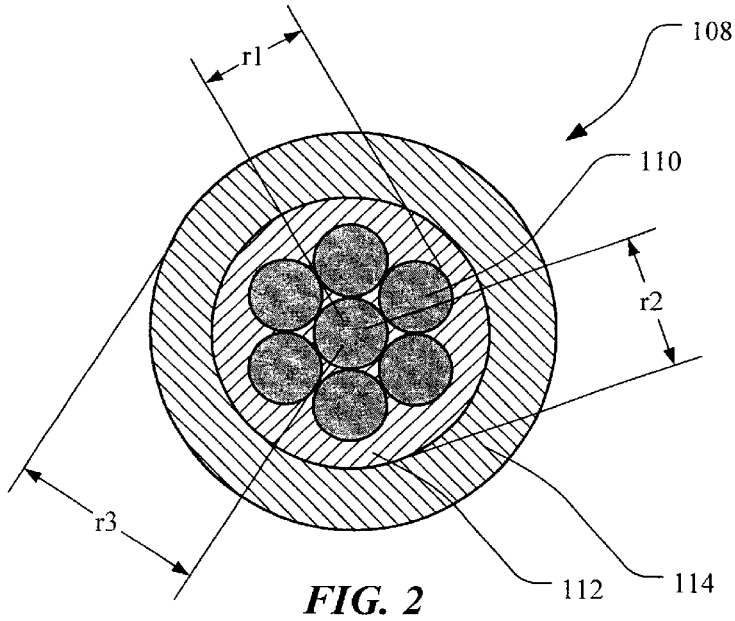
FIG. 2 is a stylized cross-sectional view of an insulated conductor of the cable shown in FIG. 1.

One of the outer insulated conductors 108 of FIG. 1 is illustrated in FIG. 2. In the illustrated embodiment, the outer conductor 110 is shown as a stranded conductor but may alternatively be a solid conductor. For example, the outer conductor 110 may be a seven-strand copper wire conductor having a central strand and six outer strands laid around the central strand. Further, various dielectric materials have different relative permittivities, i.e., different abilities to permit the opposing electric field to exist, which are defined relative to the permittivity of a vacuum. Higher relative permittivity materials can store more energy than lower relative permittivity materials. In the illustrated embodiment, the first insulating jacket 112 is made of a dielectric material having a relative permittivity within a range of about 2.5 to about 10.0, such as PEEK, polyphenylene sulfide polymer (PPS), polyvinylidene fluoride polymer (PVDF), or the like. Further, the second insulating jacket 114 is made of a dielectric material having a relative permittivity generally within a range of about 1.8 to about 5.0, such as polytetrafluoroethylene-perfluoromethylvinylether polymer (MFA), perfluoroalkoxyalkane polymer (PFA), polytetrafluoroethylene polymer (PTFE), ethylene-tetrafluoroethylene polymer (ETFE), ethylene-polypropylene copolymer (EPC), other fluoropolymers, or the like. Such dielectric materials have a lower relative permittivity than those of the dielectric materials of the first insulating jacket 112. As a result of the combination of the first insulating jacket 112 and the second insulating jacket 114, tangential electric fields are introduced and the resulting electric field has a lower intensity than in single-layer insulation.

More than two jackets of insulation (e.g., the first insulating jacket 112 and the second insulating jacket 114) may be used according to the present invention. For example, three insulating jackets may be used, with the insulating jacket most proximate the conductor having the highest relative permittivity and the insulating jacket most distal from the conductor having the lowest relative permittivity.

In a test conducted to verify the effect of using a two layer insulation as described above, ten samples of a 22 AWG copper conductor were overlaid with a 0.051 mm-thick jacket of PEEK followed by a 0.203 mm-thick jacket of MFA, which has a lower relative permittivity than that of PEEK. Similarly, ten samples of a 14 AWG copper conductor were overlaid with a 0.051 mm-thick jacket of PEEK followed by a 0.438 mm-thick jacket of MFA. An additional ten samples of a 22 AWG copper conductor were overlaid with a single 0.254 mm-thick jacket of MFA. Further, ten samples of a 14 AWG copper conductor were overlaid with a single 0.489 mm-thick jacket of MFA. Thus, in each of the corresponding sample sets, the conductor size and the overall insulation thickness were kept constant. The inception voltage, i.e., the voltage at which partial discharge occurred, was measured for each sample, as well as the extinction voltage, i.e., the voltage at which the partial discharges ceased. An average inception voltage was determined for each of the sample sets, which generally indicates the maximum voltage that can be handled by the jacketed conductor. Further, a minimum extinction voltage was determined for each of the sample sets, which generally indicates the voltage below which no partial discharges should occur. The test results are as follows:

| Conductor Type | Insulation Type | Minimum Extinction Voltage | Average Inception Voltage |
|---|---|---|---|
| 22 AWG | PEEK/MFA | 1.2 kV | 2.52 kV |
| 22 AWG | MFA | 0.5 kV | 1.30 kV |
| 14 AWG | PEEK/MFA | 1.3 kV | 3.18 kV |
| 14 AWG | MFA | 1.0 kV | 1.92 kV |

Thus, in this test, the average inception voltage for PEEK/MFA-jacketed conductors was over 1000 volts greater than the average inception voltage for MFA-jacketed conductors.

Further, in certain transmission modes, cable with PEEK/MFA-jacketed conductors experienced less signal transmission loss than conventionally jacketed conductor cables.

However, the first insulating jacket 112 is also capacitive, i.e., capable of storing an electrical charge. This charge may attenuate the electrical current flowing through the outer conductor 110, since the charge leaks from the dielectric material into the surrounding cable structure over time. Such attenuation may cause a decreased amount of electrical power to be delivered through the outer conductor 110 and/or cause electrical data signals flowing through the outer conductor 110 to be corrupted. Thus, the thickness and/or the relative permittivity of the first insulating jacket 112 must be managed to provide electric field suppression while providing an acceptably low level of capacitance. For example, an acceptable capacitance of the jacketed conductor may be within the range of about one picofarad to about eight picofarads. In one embodiment, the first insulating jacket 112 has a relative permittivity only slightly greater than that of the second insulating jacket 114, so that a small increase in capacitance is produced while achieving suppression of the electric field. In one embodiment of the present invention, the first insulating jacket 112 is made of PEEK and has a thickness within a range of about 0.051 mm to about 0.153 mm.

By suppressing the electric field produced by the voltage applied to the outer conductor 110, the voltage rating of the outer conductor 110 may be increased, as evidenced by the test data presented above. If the voltage rating of a conventionally insulated conductor (e.g., the MFA-insulated conductors of the test presented above, or the like) is acceptable, for example, the diameter of the outer conductor 110 may be increased while maintaining a substantially equivalent overall insulation diameter, such that its current carrying capability is increased. In this way, larger amounts of power may be transmitted over each of the outer conductors 110, thus eliminating the need for using the armor layers 120, 122 for carrying return power in certain situations.

The central insulated conductor 102, as illustrated in FIG. 1, includes only the insulating jacket 106 of lower relative permittivity material similar to that of the second insulating jacket 114 of the outer insulated conductor 108. In certain circumstances, there may be insufficient space between the outer insulated conductors 108 to add even a thin insulating jacket (e.g., the first insulating jacket 112 of the outer insulated conductor 108, or the like). Thus, in this embodiment, no higher relative permittivity insulating jacket is provided. The scope of the present invention, however, encompasses a central insulated conductor 102 having a makeup comparable to that of the outer insulated conductors 108.

According to the present invention, the central insulated conductor 102 and each of the outer insulated conductors 108 may carry electrical power, electrical data signals, or both. In one embodiment, the central insulated conductor 102 is used to carry only electrical data signals, while the outer insulated conductors 108 are used to carry both electrical power and electrical data signals. For example, three of the outer insulated conductors 108 may be used to transmit electrical power to the one or more devices attached thereto, while the other three are used as paths for electrical power returning from the device or devices. Thus, in this embodiment, the first armor layer 120 and the second armor layer 122 may not be needed for electrical power return.

Figure 3:
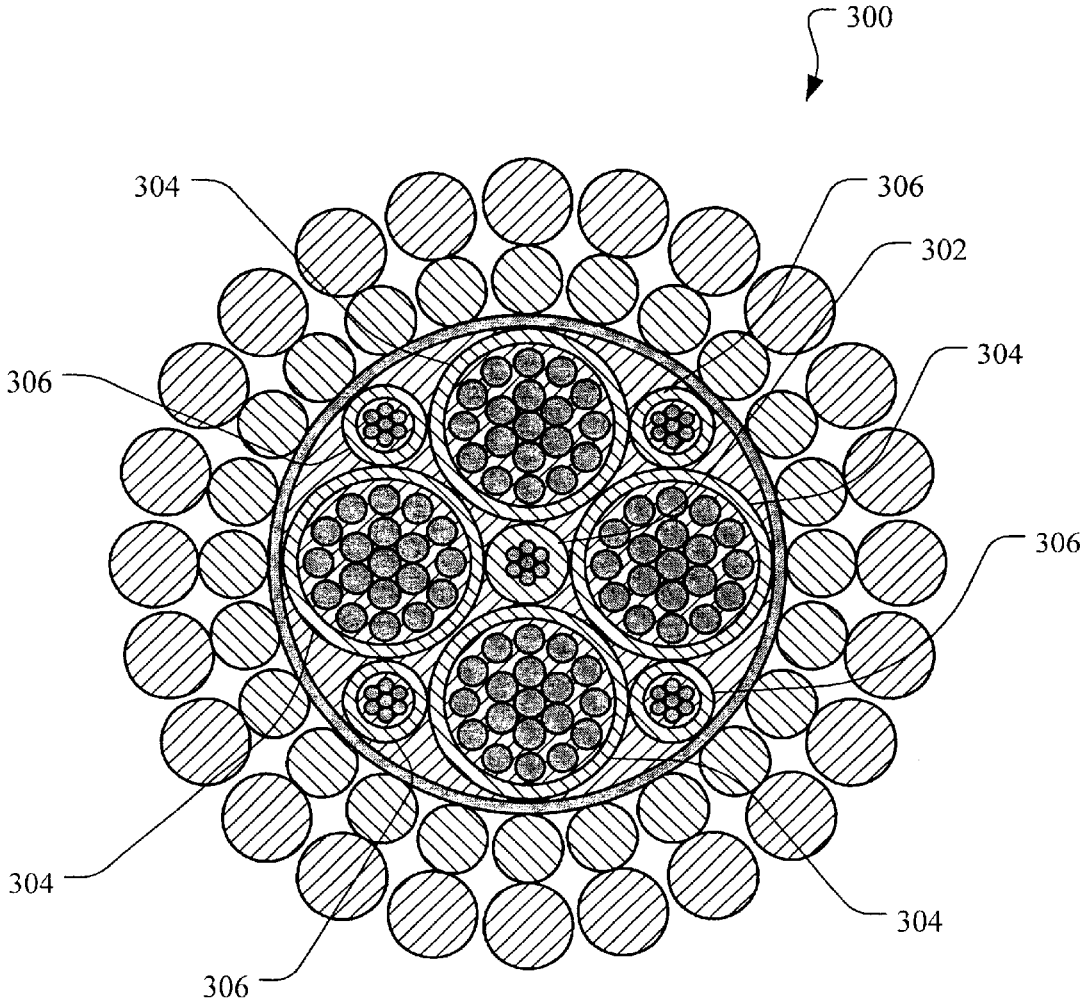
FIG. 3 is a stylized cross-sectional view of a second illustrative embodiment of a cable according to the present invention.

A cable according to the present invention may have many configurations that are different from the configuration of the cable 100 shown in FIG. 1. For example, FIG. 3 illustrates a second embodiment of the present invention. A cable 300 has a central insulated conductor 302 that is comparable to the central insulated conductor 102 of the first embodiment shown in FIG. 1. Surrounding the central conductor 302 are four large insulated conductors 304 and four small insulated conductors 306. In the illustrated embodiment, each of the large insulated conductors 304 and the small insulated conductors 306 are comparable to the outer insulated conductors 108 of the first embodiment illustrated in FIGS. 1 and 2. While particular cable configurations have been presented herein, cables having other quantities and configurations of conductors are within the scope of the present invention.

Figure 4:
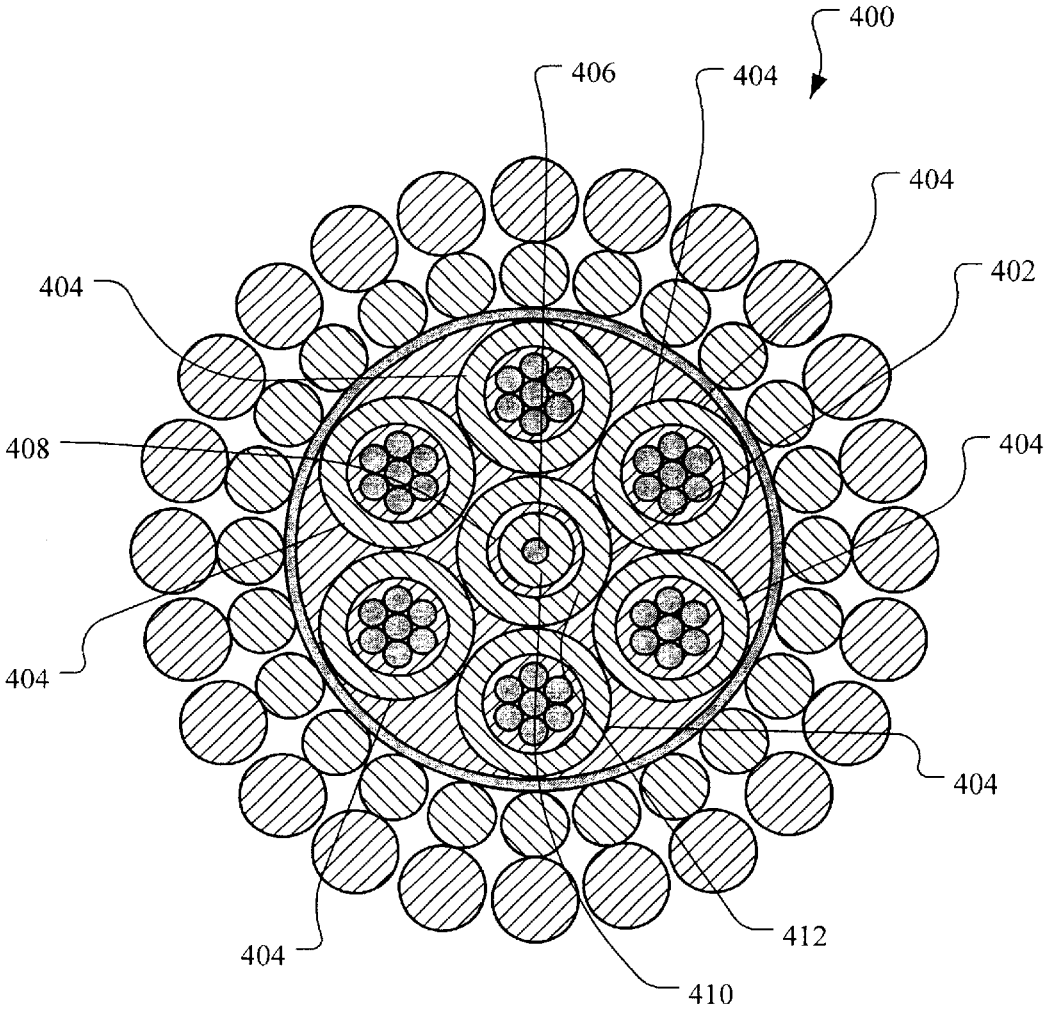
FIG. 4 is a stylized cross-sectional view of a third illustrative embodiment of a cable according to the present invention.

The present invention is not limited, however, to cables having only electrical conductors. FIG. 4 illustrates a third embodiment of the present invention that is comparable to the first embodiment (shown in FIG. 1) except that the central conductor 102 of the first embodiment has been replaced with a fiber optic assembly 402. In the illustrated embodiment, outer insulated conductors 404 are used to transmit electrical power to and from the device or devices attached thereto and the fiber optic assembly 402 is used to transmit optical data signals to and from the device or devices attached thereto. In certain situations, the use of the fiber optic assembly 402 to carry data signals, rather than one or more electrical conductors (e.g., the central insulated conductor 102, the outer insulated conductors 108, or the like), may result in higher transmission speeds, lower data loss, and higher bandwidth.

In the embodiment illustrated in FIG. 4, the fiber optic assembly 402 includes a fiber optic bundle 406 surrounded by a protective jacket 408. The protective jacket 408 may be made of any material capable of protecting the fiber optic bundle 406 in the environment in which the cable 400 is used, for example, stainless steel, nickel alloys, or the like. Additionally, the protective jacket 408 may be wrapped with copper tape, braid, or serve (not shown), or small diameter insulated wires (e.g. 26 or 28 AWG) (not shown) may be served around the protective jacket 408. In the illustrated embodiment, a filler material 410 is disposed between the fiber optic bundle 406 and the protective jacket 408 to stabilize the fiber optic bundle 406 within the protective jacket 408. The filler material 410 may be made of any suitable material, such as liquid or gelled silicone or nitrile rubber, or the like. An insulating jacket 412 surrounds the protective jacket 408 to electrically insulate the protective jacket 408. The insulating jacket 412 may be made of any suitable insulator, for example PTFE, EPDM, or the like.

In one application of the present invention, the cables 100, 300, 400 are used to interconnect well logging tools, such as gamma-ray emitters/receivers, caliper devices, resistivity-measuring devices, neutron emitters/receivers, and the like, to one or more power supplies and data logging equipment outside the well. Thus, the materials used in the cables 100, 300, 400 are, in one embodiment, capable of withstanding conditions encountered in a well environment, such as high temperatures, hydrogen sulfide-rich atmospheres, and the like.

Figure 5:
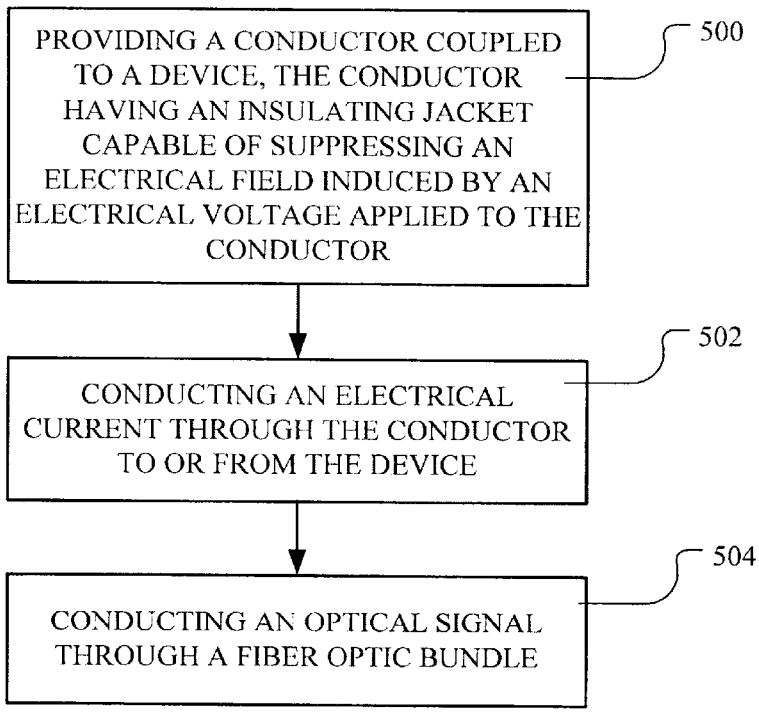
FIG. 5 is a flow chart of one illustrative method according to the present invention.
Figure 6:
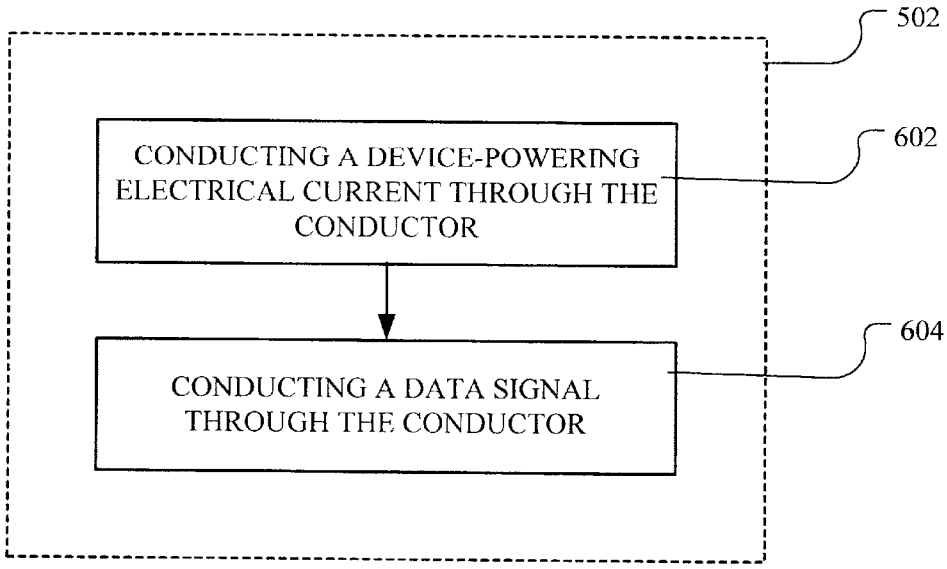
FIG. 6 is a flow chart of another illustrative method according to the present invention.

FIG. 5 illustrates a method according to the present invention. The method includes providing a conductor that is coupled to a device, the conductor having a multi-layered insulating jacket capable of suppressing an electrical field induced by an electrical voltage applied to the conductor (block 500). The method further includes conducting an electrical current through the conductor to or from the device (block 502). The method may further include conducting an optical signal through a fiber optic bundle (block 504). In one embodiment, as illustrated in FIG. 6, conducting the electrical current through the conductor (block 502) further includes conducting a device-powering electrical current through the conductor (block 602) and conducting a data signal through the conductor (block 604). The scope of the present invention also encompasses only conducting the device-powering electrical current through the conductor (block 602) or only conducting the data signal over the conductor (block 604).

Figure 7:
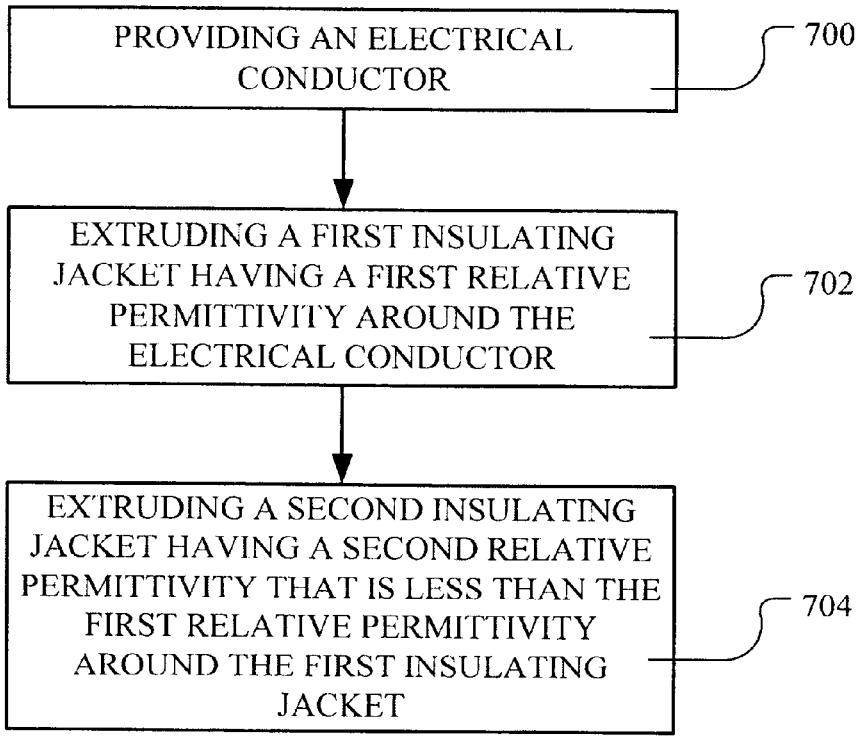
FIG. 7 is a flow chart of an illustrative method of manufacturing an electrical cable.

FIG. 7 illustrates a method for manufacturing an insulated conductor according to the present invention. The method includes providing an electrical conductor (block 700), extruding a first insulating jacket having a first relative permittivity around the electrical conductor (block 702) and extruding a second insulating jacket having a second relative permittivity that is less than the first relative permittivity around the first insulating jacket (block 704). The relative permittivity values and thicknesses of the first insulating jacket and the second insulating jacket may be commensurate with those described previously. The first insulating jacket may be placed around the electrical conductor by using a compression extrusion method, a tubing extrusion method, or by coating, while the second insulating jacket may be extruded around the first insulating jacket by a tubing extrusion method, a compression extrusion method, or a semi-compression extrusion method.

Figure 8:
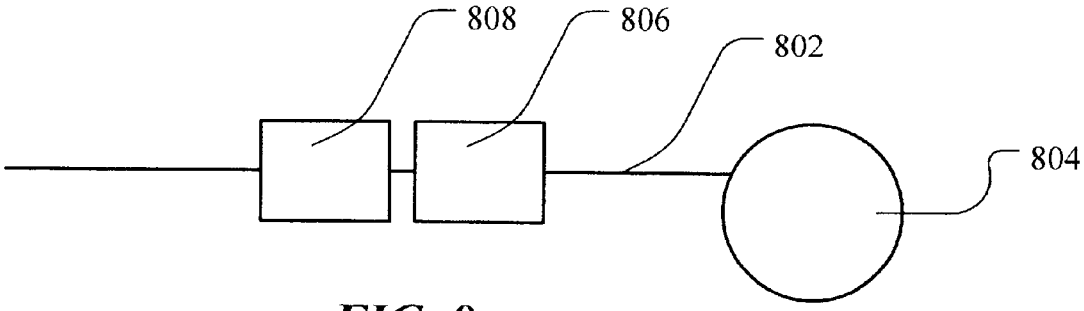
FIG. 8 is a stylized diagram of an illustrative method of manufacturing an electrical cable.

For example, as illustrated in FIG. 8, a conductor 802 stored on a spool 804 is paid out through a first extrusion device 806 to apply a first insulating jacket (e.g., the first insulating jacket 112 of FIG. 2). A second insulating jacket (e.g., the second insulating jacket 114 of FIG. 2) is then applied around the first insulating jacket by a second extrusion device 808.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. In particular, every range of values (of the form, "from about a to about b," or, equivalently, "from approximately a to b," or, equivalently, "from approximately a–b") disclosed herein is to be understood as referring to the power set (the set of all subsets) of the respective range of values, in the sense of Georg Cantor. Accordingly, the protection sought herein is as set forth in the claims below.

What is claimed is:

1. A cable comprising:

an electrical conductor;

a first insulating jacket disposed adjacent the electrical conductor and having a first relative permittivity, wherein the first insulating jacket is made of polyaryletherether ketone polymer or polyphenylene sulfide polymer; and a second insulating jacket disposed adjacent the first insulating jacket and having a second relative permittivity that is less than the first relative permittivity, and wherein the first insulating jacket is mechanically bonded to the second insulating jacket.

2. A cable according to claim 1, wherein the first relative permittivity is within a range of about 2.5 to about 10.0.

3. A cable according to claim 1, wherein the second relative permittivity is within a range of about 1.8 to about 5.0.

4. A cable according to claim 1, wherein a thickness of the first insulating jacket is within a range of about 0.051 mm to about 0.153 mm.

5. A cable according to claim 1, wherein the second insulating jacket is made of a material selected from the group consisting of polytetrafluoroethylene-perfluoromethylvinylether polymer, perfluoro-alkoxyalkane polymer, polytetrafluoroethylene polymer, ethylene-tetrafluoroethylene polymer, ethylene-polypropylene copolymer, and fluoropolymer.

6. A cable according to claim 1, further comprising:

a jacket surrounding the second insulating jacket; and a filler disposed between the jacket and the second insulating jacket.

7. A cable according to claim 6, further comprising an armor layer surrounding the jacket.

8. A cable according to claim 1, further comprising:

an electrically non-conductive jacket surrounding the second insulating jacket; and a filler disposed between the jacket and the second insulating jacket.

9. A cable according to claim 8, wherein the electrically non-conductive jacket is made from a material selected from the group consisting of the polyaryletherether ketone family of polymers, ethylene tetrafluoroethylene copolymer, fluoropolymer, and polyolefin.

10. A cable according to claim 1, further comprising:

a jacket surrounding the second insulating jacket; and an electrically non-conductive filler disposed between the jacket and the second insulating jacket.

11. A cable according to claim 10, wherein the electrically non-conductive filler is made from a material selected from the group consisting of ethylene propylene diene monomer, nitrile rubber, polyisobutylene, and polyethylene grease.

12. A cable according to claim 1, wherein a capacitance of the electrical conductor in combination with the first insulating jacket and the second insulating jacket is within the range of about one picofarad to about eight picofarads.

13. A cable comprising:

an electrical conductor;

a first insulating jacket disposed adjacent the electrical conductor and having a first relative permittivity, wherein the first insulating jacket is made of polyaryletherether ketone polymer or polyphenylene sulfide polymer; and a second insulating jacket disposed adjacent the first insulating jacket and having a second relative permittivity that is less than the first relative permittivity, and wherein the first insulating jacket is chemically bonded to the second insulating jacket.

14. A cable comprising:

an electrical conductor;

a first insulating jacket disposed adjacent the electrical conductor and having a first relative permittivity, wherein the first insulating jacket is made of polyaryletherether ketone polymer or polyphenylene sulfide polymer; and a second insulating jacket disposed adjacent the first insulating jacket and having a second relative permittivity that is less than the first relative permittivity, and wherein the interface between the first insulating jacket and the second insulating jacket is substantially free of voids.

15. A cable comprising:

an electrical conductor;

a first insulating jacket disposed adjacent the electrical conductor and having a first relative permittivity, wherein the first insulating jacket is made of polyaryletherether ketone polymer or polyphenylene sulfide polymer;

a second insulating jacket disposed adjacent the first insulating jacket and having a second relative permittivity that is less than the first relative permittivity; and a fiber optic bundle.

16. A cable comprising:

an electrical conductor;

a first insulating jacket disposed adjacent the electrical conductor and having a first relative permittivity, wherein the first insulating jacket is made of polyaryletherether ketone polymer or polyphenylene sulfide polymer;

a second insulating jacket disposed adjacent the first insulating jacket and having a second relative permittivity that is less than the first relative permittivity;

a fiber optic bundle;

a protective jacket surrounding the fiber optic bundle; and a filler material disposed between the fiber optic bundle and the protective jacket.

17. A cable according to claim 16, further comprising copper tape, braid, or serve wrapped around the protective jacket.

18. A cable according to claim 16, further comprising small diameter insulated wires served around the protective jacket.

19. A cable comprising:

a plurality of electrical conductors;

a plurality of first insulating jackets each disposed adjacent one of the electrical conductors and having a first relative permittivity, wherein the first insulating jackets are made of polyaryletherether ketone polymer or polyphenylene sulfide polymer;

a plurality of second insulating jackets each disposed adjacent one of the first insulating jackets and having a second relative permittivity that is less than the first relative permittivity;

a jacket surrounding the plurality of insulated electrical conductors;

wherein a void exists between the jacket and the plurality of insulated electrical conductors and the void is filled with an electrically non-conductive filler.

20. A cable comprising:

an electrical conductor;

a first insulating jacket disposed adjacent the electrical conductor and having a first relative permittivity; and a second insulating jacket disposed adjacent the first insulating jacket and having a second relative permittivity that is less than the first relative permittivity, and wherein the second insulating jacket is made of a material selected from the group consisting of polytetrafluoroethylene-perfluoromethylvinylether polymer, perfluoro-alkoxyalkane polymer, and ethylene-polypropylene copolymer.

21. A cable according to claim 20, wherein the first insulating jacket is made of polyvinylidene fluoride.

22. A cable comprising:

a plurality of electrical conductors;

a plurality of first insulating jackets each disposed adjacent one of the electrical conductors and having a first relative permittivity;

a plurality of second insulating jackets each disposed adjacent one of the first insulating jackets and having a second relative permittivity that is less than the first relative permittivity, and wherein the second insulating jackets are made of a material selected from the group consisting of polytetrafluoroethylene-perfluoromethylvinylether polymer, perfluoro-alkoxyalkane polymer, and ethylene-polypropylene copolymer;

a jacket surrounding the plurality of insulated electrical conductors;

wherein a void exists between the jacket and the plurality of insulated electrical conductors.

23. A cable according to claim 22, wherein the void is filled with an electrically conductive filler.

24. A cable according to claim 22, wherein the void is filled with an electrically non-conductive filler.

* * * * *